United States Patent [19]

Stange

[11] 3,941,373

[45] Mar. 2, 1976

[54] FLOATING GATE SHEET SEPARATOR

[75] Inventor: Klaus K. Stange, Pittsford, N.Y.

[73] Assignee: Xerox Corporation, Stamford, Conn.

[22] Filed: Nov. 25, 1974

[21] Appl. No.: 527,114

[52] U.S. Cl. ..... 271/124; 271/34; 271/170

[51] Int. Cl.[2] ..... B65H 5/02

[58] Field of Search ..... 271/10, 34, 35, 37, 114, 271/116, 117, 124, 170

[56] References Cited

UNITED STATES PATENTS

| | | | |
|---|---|---|---|
| 3,260,521 | 7/1966 | Moxness | 271/116 |
| 3,768,803 | 10/1973 | Stange | 271/34 |
| 3,825,248 | 7/1974 | Friend | 271/116 |

OTHER PUBLICATIONS

IBM Technical Disclosure Bulletin, "Sheet Paper Feed System," Cavdill et al., Vol. 14, No. 5, Oct. 1971.

*Primary Examiner*—Evon C. Blunk
*Assistant Examiner*—Robert Saifer

[57] ABSTRACT

A sheet feeding device adapted to separate a single sheet from a stack of sheets and forward the separated sheet away from the stack for subsequent processing. The apparatus includes a feed belt disposed adjacent one edge of the stack for contact with the lead edge of the top sheet in the stack to separate the sheet therefrom. Gate means biased into engagement with the feed belt provide a forward stop for the sheet stack, actuation of the feed belt causing the top sheet in the stack to be forced between the low friction upper surface of the gate means and the feed belt to move the top sheet off from the stack, the biased gate means preventing passage of multiple sheets by the feed means.

2 Claims, 4 Drawing Figures

FLOATING GATE SHEET SEPARATOR

BACKGROUND OF THE INVENTION

In modern, high speed sheet processing machines such as printers, sorters, collators, reproduction machines, etc., a sheet misfeed or multi-fed sheets can seriously impair the operation of the machine. Numerous devices of the type disclosed in U.S. Pat. Nos. 3,768,803 and 390,277 have been proposed to positively separate the top sheet from a stack of sheets and prevent feeding of more than one sheet at a time through the apparatus. In high speed printing machines, one of the most common methods utilized to separate sheets is sniffer tubes which are moved into contact with the top sheet in the stack, lift the sheet by vacuum from the stack and forward it into take-away rolls. Another common means for separating sheets is to employ a feed roll or feed belt in contact with the top sheet in the stack to separate the sheet therefrom. To prevent multi-feeds, a retard pad such as disclosed in U.S. Pat. No. 3,768,803 or a counter-rotating retard roller driven through suitable clutch means may be utilized to prevent the passage of more than one sheet to the take-away rolls downstream therefrom.

It is obvious that sniffer tubes require a source of vacuum and a fairly complex mechanism to move the tubes into and out of contact with the stack for lifting the sheets therefrom and carrying them to the take-away rolls. When utilizing a stationary retard pad along with a feed belt or feed roller, selection of the retard pad material becomes extremely critical due to the possibility of rapid wear of the retard pad or contamination of the pad by paper fibers or other materials utilized in the manufacture of paper such as clay filler. When utilizing a counter-rotating retard roll, it is necessary to provide a separate drive for the retard roll or drive the roll through suitable chains or belts from other drive means in the apparatus. Further, suitable slip clutch means must also be provided, which means are subject to wear, requiring periodic replacement thereof.

Card feeders of the type utilized for punch cards ordinarily employ a stationary gate which is adjusted to provide a slot for passage of cards therethrough which is greater than the thickness of the card but less than the thickness of two cards to prevent feeding of multiple cards. This system is very effective where the thickness of the cards or the sheets is closely controlled.

It is an object of the present invention to provide a sheet feeder which is adapted to handle a wide range of paper weights without adjustment thereto, which is extremely simple and therefore inexpensive, and which is subjected to minimal wear throughout the life of the machine.

SUMMARY OF THE INVENTION

This invention relates to an apparatus for feeding and separating individual sheets from a stack of sheets including a first feed roll disposed adjacent the forward edge of the stack and a second roll disposed adjacent thereto, a feed belt being mounted on the first and second rolls for movement therearound. A low friction feed gate is disposed adjacent the front edge of the stack and biased into engagement with the feed belt, the gate acting to maintain the forward edge of the stack in alignment and prevent passage of more than one sheet at a time between the gate edge and the feed belt.

DESCRIPTION OF THE PREFERRED EMBODIMENT

Figure 1:
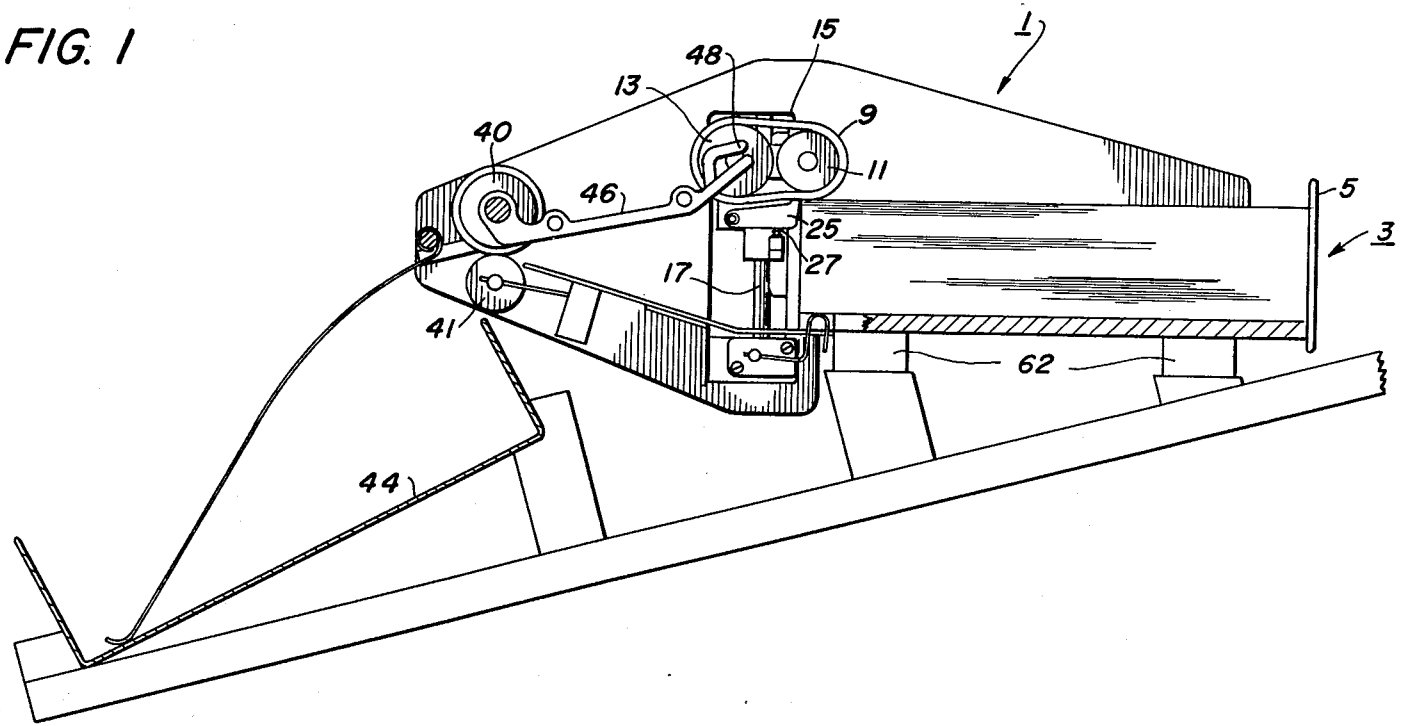
FIG. 1 is a side view of the sheet feeding and separating apparatus of the present invention.
Figure 4:
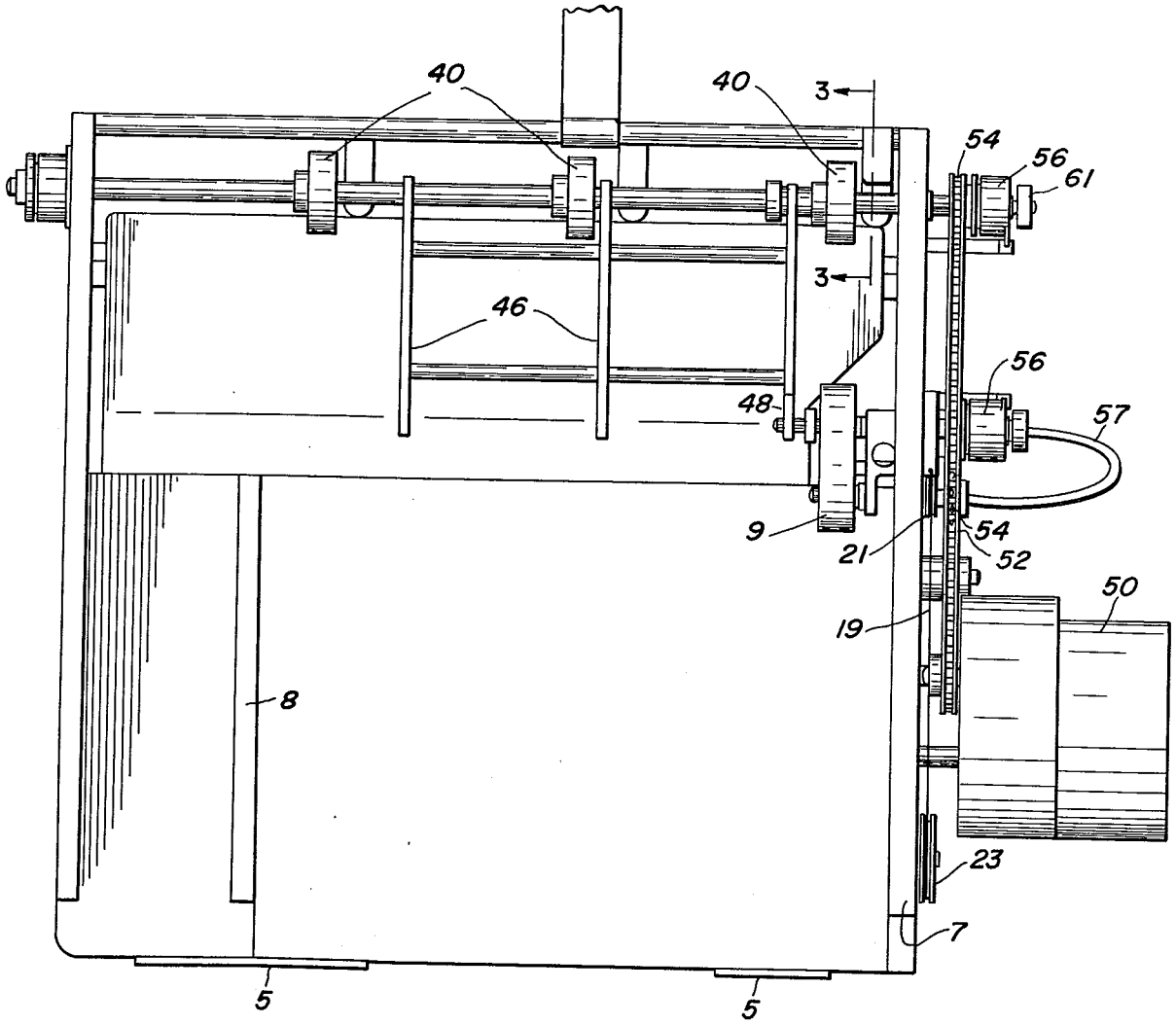
FIG. 4 is a top plan view of the sheet feeding and separating apparatus illustrated in FIG. 1.

Referring to FIG. 1 of the drawings, there is illustrated a sheet feeding and separating apparatus 1 including a stationary sheet tray 3 adapted for receiving a stack of sheets therein. The tray is provided with a back wall 5 and side walls 7 and 8 (FIG. 4). Wall 8 may be adjustable toward wall 7 to compensate for sheets of varying widths. A sheet feeding and separating belt 9 mounted for movement about rolls 11 and 13 is mounted closely adjacent side wall 7 of the apparatus. The axis of rolls 11 and 13 may be slightly canted to provide a belt orientation running at a slight angle toward the side wall 7 for reasons to be hereinafter explained. It should be understood that while a belt-type feeder is illustrated, a single roll feeder having an axis at approximately the same location as the axis of roll 11 could also be utilized within the context of the present invention. In the illustrated embodiment, the rolls 11 and 13 are mounted on a suitable carriage 15 adapted for movement along a guide 17. The carriage is suitably counter-balanced by means of a cable 19 attached thereto adapted for cooperation with pulley 21 mounted on side wall 7 above the carriage, the cable 19 being connected at its other end to a negator spring 23. The negator spring would be selected to compensate for the majority of the weight of the carriage 15, the non-compensated weight providing a slight downward pressure by feed belt 9 against the top sheet in the stack. As the stack of sheets is depleted, the weight of the carriage would allow the rolls 11, 13 and the belt 9 thereon to move downwardly and remain in contact with the top sheet in the stack. The use of a feed mechanism mounted on a "floating" carriage to follow the depletion of the stack is particularly suitable for use when "cassette" type sheet or paper trays are to be utilized. In the event that a large quantity of sheets are to be stacked, it may be desirable to provide a substantially stationary feed mechanism for use in conjunction with a paper stack elevator adapted to maintain the top sheet adjacent the feed mechanism as the stack is depleted. Further, the feed mechanism could be inverted and utilized as a bottom feeder to feed sheets from the bottom of a stack rather than the top as illustrated.

A floating gate separator 25 is biased upwardly into contact with belt 9 at the forward edge of the sheet stack by suitable spring means 27. Floating gate 25 is pivotally mounted on carriage 15 by means of a pivot pin 29 and a suitable fastener such as a snap ring 31. Floating gate separator 25 is formed of an extremely hard, wear resistant, low friction material and is provided with a relieved portion 33 for reasons to be hereinafter explained.

A plurality of take-away roller pairs 40, 41 and roller pair 40, 42 are provided immediately downstream from the feed belt 9 for receiving sheets separated from the stack and feeding the sheets into subsequent processing apparatus with which the sheet feeding and separating mechanism may be utilized. For purposes of illustration only, a sheet delivery tray 44 is illustrated immediately downstream from take-away roll pair 40, 42 to receive the sheets separated and fed by the apparatus 1, it being understood that in normal usage, the roll pairs 40, 41 and 40, 42 would feed the sheets to a downstream processor such as a xerographic copy machine. An upper guide grid 46 is pivotally mounted on the shaft that supports rolls 40. The guide grid is provided with a follower tab 48 to enable the guide 46 to pivot downwardly as the carriage 15 moves downwardly during depletion of the stack to provide an upper guide for directing the sheets from the separator mechanism to take-away rolls 40, 41 and 40, 42. The rolls 40 and roll 13 may be driven by a suitable motor 50 through a chain 52, sprockets 54, and clutches 56. Since roll 13 is adapted for movement with carriage 15 along guide 17, the sprocket 54 and clutch 56 associated therewith may be drivingly connected by means of a flexible drive shaft 57, although it should be understood that a separate drive motor could be utilized to drive the roll 13, the added weight of a separate drive motor, however, requiring a stronger negator spring 23 to counterbalance the carriage.

Figure 3:
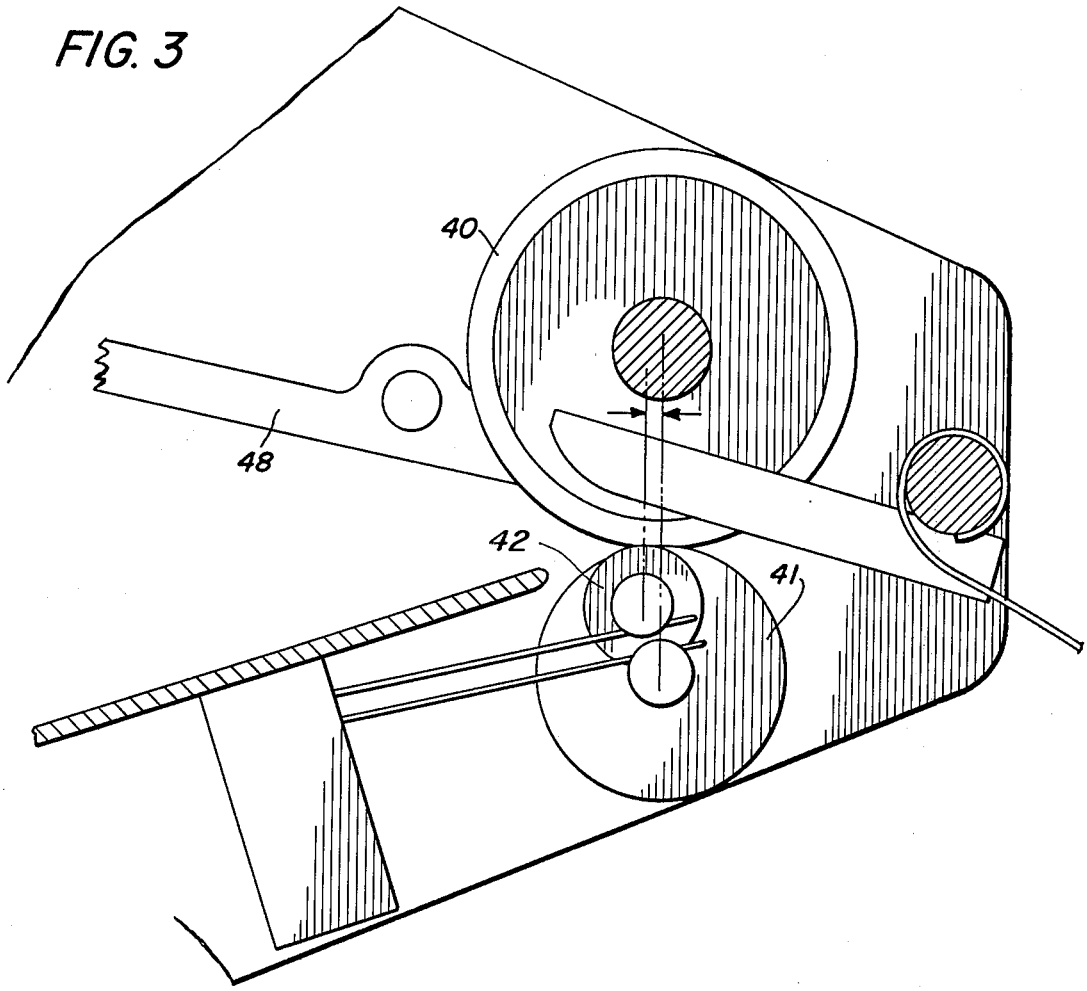
FIG. 3 is an enlarged view of the take-away rolls illustrated in FIG. 1 along line 3—3 of FIG. 4.

Referring to FIG. 3, which is a view taken along lines 3—3 of FIG. 4, it can be seen that the take-away idler roll 42 immediately downstream from the separator belt 9, is of a smaller diameter than the remainder of the take-away idler rolls 41. Further, by reference to FIG. 3, it can be seen that the smaller idler roll 42 is mounted on an axis a short distance in advance of the axis of the remainder of the idler rolls 41 for reasons to be hereinafter explained.

Figure 2:
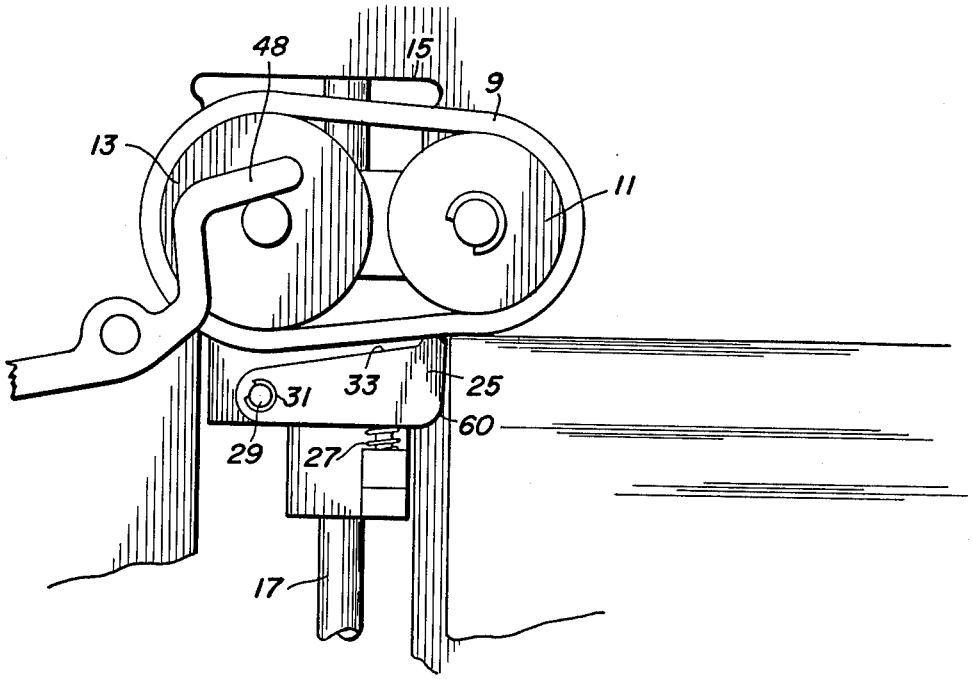
FIG. 2 is an enlarged view of the feed beltfloating gate sub-assembly utilized in the sheet feeding apparatus of FIG. 1.

Considering the operation of the sheet feeding and separating apparatus, upon initial actuation of roller 13 and belt 9, the top sheet in the stack will be forced between belt 9 and floating gate separator 25. The upper right-hand corner of floating gate separator 25, as illustrated in FIG. 2, is provided with a slight bevel or chamfer to aid in directing the lead edge of the top sheet between gate 25 and belt 9. The edge 60 of gate 25 will provide a stop for the remainder of the sheets in the stack and prevent more than one sheet from entering the nip between gate 25 and belt 9. It should be understood that the sheets immediately beneath the top sheet being fed are prevented from being dragged along with the top sheet due to the forward edge 60 of the gate 25 and that the upper surface of gate 25 in contact with the lower surface of the sheet being fed does not act as a retard member since it is formed of an extremely hard, low friction material. However, the biasing force generated by spring 27 helps prevent multiple sheets from being dragged therebetween. Further, by providing a biased gate, belt run-out, belt wear, and changes in belt surface frictional characteristics have no effect on the ability of the floating gate to prevent multifeeds.

A special feature of the disclosed separating mechanism is the gentleness with which the sheets are separated. With normal retard type feeders, a substantial force must be exerted on the sheet being fed to overcome the drag produced thereon by the retard pad or roll. Further, the abrasive action of the retard mechanism does not allow common sheet separating devices to handle delicate materials such as film stock. Due to the gentleness with which the disclosed device can be handled thereby without scratching or marring the delicate film surface.

As an example of the minimal forces necessary in the operation of the disclosed device, excellent results have been obtained in tests wherein the normal force of belt 9 against the paper stack is approximately 0.2 lbs, or less, the force of gate 25 against belt 9 is approximately 0.3 lbs. or less, and the total driving force necessary to drive belt 9 is less than 0.3 in./lbs. torque. When examining these forces one can readily appreciate the gentleness of the disclosed separator.

In the event that it is desirable to provide spacing between individual sheets being fed by the apparatus, the take-away rolls may be driven at a faster peripheral speed than the belt 9, and the roll 13 may be driven by means of a one-way clutch which will allow the belt 9 to speed up when the lead edge of the sheet is received in the nip of take-away rolls 40 and 41 and 40, 42 and accelerated thereby. Irrespective of the relative speed of the belt 9 and take-away roll pairs 40, 41, and 40, 42 the disclosed sheet separating and feeding mechanism ordinarily would be operated by energizing both the belt 9 and the take-away rolls 40, 41 and 40, 42 substantially simultaneously to feed a sheet from the stack to the take-away rolls. After the lead edge reaches the take-away rolls 40, 41, and 40, 42 the belt 9 would be deactivated. If the take-away roll pairs 40, 41 and 40, 42 are to be utilized as a registration station, they may also be deactivated at the same time. In any event, as the trailing edge of the sheet passes between belt 9 and the separator 25, the belt 9 will be moving either under the influence of its drive mechanism or due to the force exerted thereon by the sheet as the sheet is pulled forward by the take-away rolls. This will cause the succeeding sheet in the stack to follow the previous sheet into the nip between the separator and the feed roll. As the take-away rolls are moving the sheet away from the belt, once the trail edge of the forward sheet reaches the relieved portion of the separator, a drag force will no longer be exerted on the belt by the sheet, thereby allowing the belt to stop or if it is energized, to operated at its normally driven speed. Thus, if the feed belt is not energized, the succeeding sheet will only be dragged into the nip between the belt and the separator gate a distance equal to the unrelieved area of the separator in contact with the belt. This simplifies removal of the remainder of the sheets in the stack in the event the operator wishes to replace the sheets therein with a different type or size of sheet since the top sheet, which is automatically dragged into the nip irrespective of whether the belt is actuated or not, is only dragged a minimal distance into the nip and is therefore easily removed therefrom. Due to the slight angular orientation of the belt relative to side wall 7, and the location of the separatar mechanism adjacent the side register edge or wall 8, the initial force on the lead corner of the sheet will cause the trail edge thereof to be swung into contact with wall 8. Further, the angular orientation of the belt will move the lead edge of the sheet forward and slightly sidewards into contact with wall 8 so that any skew which may be present in the paper is removed as the sheet is fed to the left against wall 7 by the angled belt 9.

To prevent the take-away rolls from inducing skew into the sheet, Applicants have provided a take-away roll arrangement whereby the take-away roll pair immediately downstream from belt 9 contacts the lead edge of the sheet slightly in advance of the remainder of the take-away rolls. This is accomplished by providing an axis for the idler roll 42 downstream from belt 9 slightly in advance of the axis of the remainder of the idler rolls 41. Since the lead edge of the sheet if first contacted by the roll pair 40, 42 immediately in front of belt 9, there is a tendency for this roll pair to exert a force on that corner of the sheet tending to force the trail edge of the sheet against the side registration wall 7. Thus, the deskewing effect provided by driving the sheet against the wall by the angled feed belt 9 is further enhanced by the take-away roll pair 40, 42 immediately downstream therefrom.

For optimum registration accuracy, it is necessary to maintain the lead edge of the sheet in a planar condition. The idler roll 42 immediately downstream from the belt 9 is therefore of a smaller diameter than the remainder of the idler rolls to compensate for the advanced placement of the roll axis. Stated another way, as the lead edge of the sheet contacts the surface of the take-away idler rollers, due to the smaller diameter of the leading idler roller 42, the upper surfaces of all of the idler rolls first contacted by the lead edge of the sheet lie in a common plane even though the idler roll 42 downstream from belt 9 is of a smaller diameter and located on a different axis from the remainder of the idler rolls. Through this arrangement, skew of the sheet is eliminated. As such, if desired, the take-away rolls may be utilized as a registration station for feeding the sheets in timed relation to the processing apparatus which would be located downstream thereof. To accomplish this, sensors would be employed to sense the position of the lead edge of the sheet after engagement thereof by the take-away rolls to disengage the drive clutch therefore and engage a brake 61 to stop the sheet therein. Subsequently, when it is desired to feed the sheet in timed relation to the sheet processing apparatus, the clutch would be energized, thus assuring that the sheet reaches the required processing station at the desired time.

The disclosed construction provides a very simple and versatile sheet feeder. By mounting the separator mechanism on wall 8, expensive yokes or other structure which would be required if the separator mechanism were mounted in the middle of the lead edge of the paper are unnecessary. Further, the unitary construction of the separator allows for mounting the entire structure on guide rails 62 to allow displacement thereof in a direction toward the left as viewed in FIG. 4 if the separator is mounted in a machine requiring front loading of sheets in the tray.

In the event it is necessary to center sheets of various sizes relative to the processing stations in the printer or copier in which the separator is utilized, detents or stops may be built into the guide rails to adjust the feeder to the left or right as viewed in FIG. 4 for proper alignment of the sheets fed by the separator with the processing stations of the printer or copier.

The novel sheet separating and feeding apparatus disclosed finds particular utililty in printing machines or copy machines such as xerographic copiers, offset printers, etc. which would be located downstream from the take-away rolls.

While I have described a preferred embodiment of my invention, it should be understood that the invention is not limited thereto but may be otherwise embodied within the scope of the following claims.

What is claimed is:

1. An apparatus for feeding and separating individual sheets from a stack of sheets including:

a first feed roll disposed adjacent the forward edge of the stack;

a second roll disposed adjacent said first feed roll;

a feed belt mounted on said first and second rolls for movement therearound;

a narrow, low friction feed gate disposed adjacent one corner of the front edge of the stack adapted to locate the front edges of the sheet in the stack; and, biasing means adapted to bias said feed gate into engagement with said feed belt, movement of said feed belt causing the sheet in the stack in contact therewith to be forced between said feed gate and said feed belt for movement of a single sheet off from the stack, said feed gate preventing passage of multiple sheets between said gate and said feed belt.

2. An apparatus for feeding and separating sheets according to claim 1 wherein said feed gate is pivotally mounted adjacent said feed belt, said biasing means being adapted to pivot said gate into engagement with said feed belt.

* * * * *